US007559366B2

(12) United States Patent
Hunter et al.

(10) Patent No.: US 7,559,366 B2
(45) Date of Patent: Jul. 14, 2009

(54) FLEX-LOCK METAL SEAL SYSTEM FOR WELLHEAD MEMBERS

(75) Inventors: Rick C. Hunter, Friendswood, TX (US); Anton J. Dach, Jr., Trinity, TX (US); Charles E. Jennings, Houston, TX (US); Steven C. Ellis, The Woodlands, TX (US)

(73) Assignee: Vetco Gray Inc., Houston, TX (US)

( * ) Notice: Subject to any disclaimer, the term of this patent is extended or adjusted under 35 U.S.C. 154(b) by 365 days.

(21) Appl. No.: 11/635,466

(22) Filed: Dec. 7, 2006

(65) Prior Publication Data

US 2008/0135229 A1 Jun. 12, 2008

(51) Int. Cl.
*E21B 23/00* (2006.01)
*E21B 33/03* (2006.01)

(52) U.S. Cl. ..... 166/217; 166/195; 166/208; 277/328

(58) Field of Classification Search ..... 166/195, 166/208, 217; 277/328
See application file for complete search history.

(56) References Cited

U.S. PATENT DOCUMENTS

| | | | | |
|---|---|---|---|---|
| 4,131,287 | A | | 12/1978 | Gunderson et al. |
| 4,900,041 | A | * | 2/1990 | Hopkins et al. ..... 277/328 |
| 5,246,236 | A | | 9/1993 | Szarka et al. |
| 5,285,853 | A | | 2/1994 | Eckert et al. |
| 5,456,314 | A | | 10/1995 | Boehm, Jr. et al. |
| 5,685,369 | A | | 11/1997 | Ellis et al. |
| 6,367,558 | B1 | | 4/2002 | Borak, Jr. |

* cited by examiner

*Primary Examiner*—Giovanna C Wright
(74) *Attorney, Agent, or Firm*—Bracewell & Giuliani

(57) ABSTRACT

A wellhead seal assembly forms a metal-to-metal seal between the inner and outer wellhead members. A metal seal ring has inner and outer conical walls separated by a tapered slot. An energizing ring has inner and outer annular members that are separated by an annular cavity. When the energizing ring is moved further into the slot, the cavity width decreases but remains to provide a preloaded radial force to the seal ring.

19 Claims, 2 Drawing Sheets

FLEX-LOCK METAL SEAL SYSTEM FOR WELLHEAD MEMBERS

FIELD OF THE INVENTION

This invention relates in general to wellhead assemblies and in particular to a seal for sealing between inner and outer wellhead members.

BACKGROUND OF THE INVENTION

Seals are used between inner and outer wellhead tubular members to contain internal well pressure. The inner wellhead member may be a tubing hanger that supports a string of tubing extending into the well for the flow of production fluid. The tubing hanger lands in an outer wellhead member, which may be wellhead housing, a Christmas tree, or tubing head. A packoff or seal seals between the tubing hanger and the outer wellhead member. Alternately, the inner wellhead member might be a casing hanger located in a wellhead housing and secured to a string of casing extending into the well. A seal or packoff seals between the casing hanger and the wellhead housing.

A variety of seals of this nature have been employed in the prior art. Prior art seals include elastomeric and partially metal and elastomeric rings. Prior art seal rings made entirely of metal for forming metal-to-metal seals are also employed. The seals may be set by a running tool, or they may be set in response to the weight of the string of casing or tubing. One type of prior art metal-to-metal seal has inner and outer walls separated by a conical slot. An energizing ring is pushed into the slot to deform the inner and outer walls apart into sealing engagement with the inner and outer wellhead members. The energizing ring is a solid wedge-shaped member. The deformation of the inner and outer walls exceeds the yield strength of the material of the seal ring, making the deformation permanent.

Thermal growth between the casing or tubing and the wellhead may occur, particularly with wellheads located at the surface, rather than subsea. The well fluid flowing upward through the tubing heats the string of tubing, and to a lesser degree the surrounding casing The temperature increase may cause the tubing hanger and/or casing hanger to move axially a slight amount relative to the outer wellhead member. During the heat up transient, the tubing hanger and/or casing hanger can also move radially due to temperature differences between components and the different rates of thermal expansion from which the component materials are constructed. If the seal has been set as a result of a wedging action where an axial displacement of energizing rings induces a radial movement of the seal against its mating surfaces, then sealing forces may be reduced if there is movement in the axial direction due to pressure or thermal effects. A reduction in axial force on the energizing ring results in a reduction in the radial inward and outward forces on the inner and outer walls of the seal ring, which may cause the seal to leak. A loss of radial loading between the seal and its mating surfaces due to thermal transients may also cause the seal to leak.

SUMMARY OF THE INVENTION

The seal ring of this invention forms a metal-to-metal seal and has features to accommodate thermal growth without leakage. The seal ring has inner and outer walls separated by conical slot. A metal energizing ring with inner and outer conical surfaces is pushed into the slot during installation to deform the inner and outer walls into sealing engagement with inner and outer wellhead members. The energizing ring has an internal cavity located between the inner and outer conical surfaces to allow the inner and outer conical surfaces to deflect toward each other during installation. The deflection is within the elastic range of the energizing ring, thus creating radial inward and outward preload forces. Thus when thermal displacements cause a radial movement between the seal and the mating housings, the stored energy due to the flex of the energizing rings enabled by the internal cavity, maintains near constant sealing forces. Additionally, even if the downward force on the energizing ring is reduced or lost due to thermal growth, the inward and outward directed radial forces remain as a result of the cavity in the energizing ring.

In the embodiment shown, the seal ring is bi-directional, having upper and lower sections that are the same, each containing one of the slots. Preferably a lower energizing ring engages the slot of the lower section and an upper energizing ring engages the slot of the upper section. In the embodiment shown, each energizing ring is made up of two annular members secured together, such as by threads. Each inner and outer annular member has a cavity wall surface radially spaced from the other to define the cavity. Preferably the cavity is cylindrical and extends at least the length of the wedge or engaging portion of the energizing member. Also, preferably an annular band is formed on an end of the cavity surface of at least one of the annular members to contact the other cavity surface during the installation.

In the embodiment shown, a radial gap exist between the outer wall of the seal and the inner wall of the mating housing. Such gap is required for installation in the field and is sufficiently large to require plastic deformation of the seal body, but not the energizer rings. In order to accommodate sealing over scratches and surface trauma of the wellhead member, a soft metallic outer layer may be provided for on the seal. The thickness of this outer layer is sufficient to provide for scratch filling and therefore sealing between the mating members. Additionally, multiple v-shaped grooves of the seal body are such that the soft outer layer will be trapped, which both prevents extrusion of the soft metallic material and induces high compressive stresses in the layer. Since the grooves are not exposed at the surface, they are not subject to damage from running operations. The combination of stored energy provided for by the energizer ring cavity and the compliant soft outer layer, provides gas tight sealing under extreme thermal conditions. Alternatively, the soft outer layer may be made from a non-metallic material or polymer such as PEEK (poly-ether-ether-keytone) or PPS (polyphenylene sulfide).

DETAILED DESCRIPTION OF THE INVENTION

Figure 1:
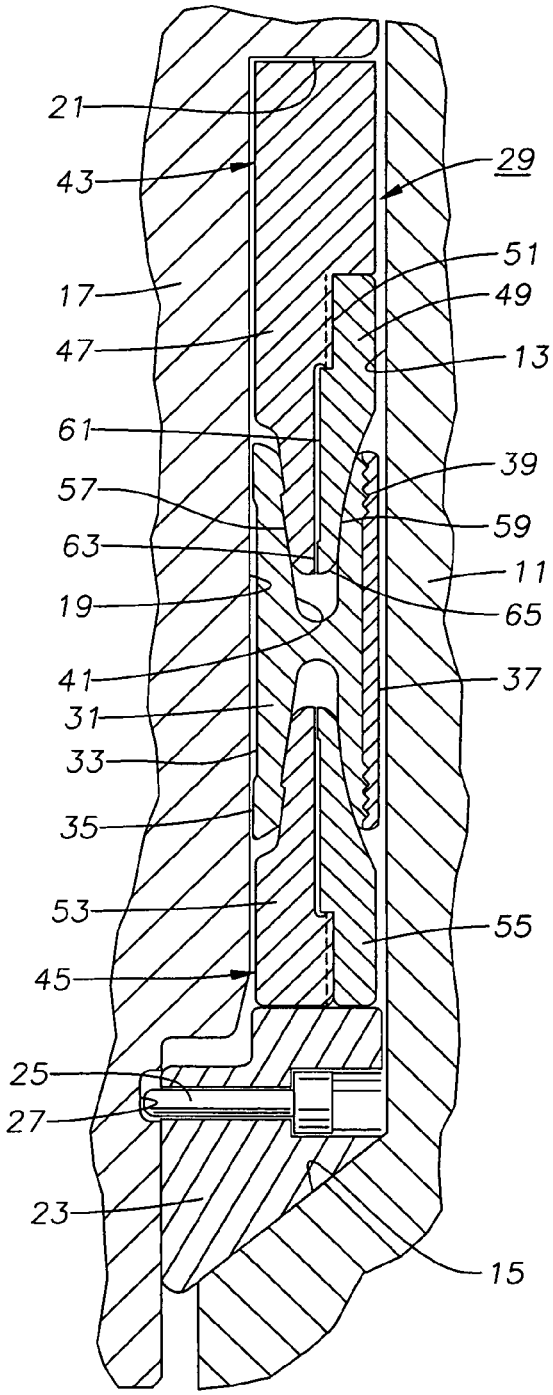
FIG. 1 is a sectional view of a seal assembly constructed in accordance with this invention, shown prior to installation.

Referring to FIG. 1, a portion of a tubing spool 11 is shown. Tubing spool 11 is located at an upper end of a well and serves as an outer wellhead member in this example. Tubing spool 11 has a bore 13 with a shoulder 15 located therein. In this embodiment, shoulder 15 is conical and faces upward and inward toward a longitudinal axis (not shown) of bore 13.

In this example, the inner wellhead member comprises a tubing hanger 17, which is shown partially in FIG. 1 within bore 13. Alternately, tubing spool 11 could be a wellhead housing or a Christmas tree. Alternately, tubing hanger 17 could be a casing hanger, plug, safety valve or other device. Tubing hanger 17 has an exterior annular recess radially spaced inward from bore 13 to define a seal pocket 19. Tubing hanger 17 has a downward facing shoulder 21 that defines the upper end of seal pocket 19. A shoulder ring 23 that has an upward facing shoulder is carried by tubing hanger 17 to define the lower end of seal pocket 19. In this example, prior to setting, shoulder ring 23 is retained on tubing hanger 17 by a shear pin 25 that extends into a hole 27 in tubing hanger 17. Shoulder ring 23 has a conical downward facing surface that lands on tubing spool shoulder 15.

A metal-to-metal seal assembly 29 is located in seal pocket 19. Seal assembly 29 includes a seal ring 31 formed of a metal such as steel. Seal ring 31 has an inner wall 33 that may have annular seal bands 35 at the upper and lower ends for sealing against the cylindrical wall of seal pocket 19. Seal ring 31 has an outer wall surface or layer 37 that seals against tubing spool bore 13. Outer layer 37 optionally comprises a sleeve of softer material than the body of seal ring 31, the sleeve being secured by threads, thermal spray, brazing or the like. Discrete v-shaped grooves 39 may be located toward each end of the body of seal ring 31. Grooves 39 are filled by outer layer 37 and serve to anchor or fix outer layer 37 against movement relative to the body of seal ring 31. Outer layer 37 could optionally be an integral portion of seal ring 31 rather than a sleeve. Outer layer 37 may be formed of a soft metal or alternatively made from a non-metallic material or polymer such as PEEK (poly-ether-ether-keytone) or PPS (polyphenylene sulfide).

In this example, seal ring 31 is bi-directional, having an upper section and a lower section that are substantially mirror images of each other. The same numerals are applied to the upper section as to the lower section. Each section has a wedge-shaped or conical slot 41 that reduces in width from its entrance to a base located centrally between the upper and lower ends of seal ring 31. The inner and outer surfaces forming each slot 41 comprise generally conical surfaces that may be straight or curved.

An upper energizing ring 43 engages slot 41 on the upper side, and a lower energizing ring 45 engages slot 41 on the lower side. Upper energizing ring 43 is forced downward into upper slot 41 by tubing hanger downward facing shoulder 21 during setting. Lower energizing ring 45 is forced upward into lower slot 41 by shoulder ring 23 during setting. Upper and lower energizing rings 43, 45 are formed of metal, such as steel. The mating surfaces of energizing rings 43, 45 and slots 41 may be formed at a locking taper to resist reverse movement of energizing rings 43, 45 after seal ring 31 has been set.

Upper energizing ring 43 includes an inner annular member 47 and an outer annular member 49. Inner and outer annular members 47, 49 are secured to each other by threads 51. Other methods could be employed for securing annular members 47, 49 to each other, such as cross pins, welding or brazing. An upper supporting portion of inner annular member 47 extends over and upward from the upper end of outer annular member 49 in this example. The radial thickness of this supporting portion of inner annular member 47 above outer annular member 49 is approximately the same as the radial thickness of seal ring 31.

Lower energizing ring 45 comprises an inner annular member 53 and an outer annular member 55. Inner and outer members 53, 55 are secured to each other, such as by threads. In this example, the axial length of lower energizing ring 45 is less than the axial length of upper energizing ring 43. Also, in this example, inner annular member 53 and outer annular member 55 have the same axial lengths. The lower portions of inner and outer members 53, 55 serve as a supporting portion of lower energizing ring 45 and define a radial width approximately the same as seal ring 31.

Each of the energizing rings 43, 45 has a wedge member or engaging portion that engages one of the slots 41. Each energizing ring 43, 45 has an inner conical surface 57 and an outer conical surface 59 for engaging the opposite inner sidewalls of each slot 41. The inner conical surface 57 of upper energizing ring 43 is formed on upper inner annular member 47. The outer conical surface 59 is formed on upper outer annular member 49. The inner and outer conical surfaces 57, 59 of lower energizing ring 45 are similarly formed on lower inner and outer annular members 53, 55. Inner and outer conical surfaces 57, 59 may be curved conical surfaces, as shown or straight conical surfaces. Serrations may be located along surfaces 57 and 59 to resist axial seal separation of seal 31 from energizing rings 43, 45. Additionally, the upper and lower interface surfaces 57 and 59 may be selectively coated to provide a differential, and thereby preferential, activation motion.

Figure 3:
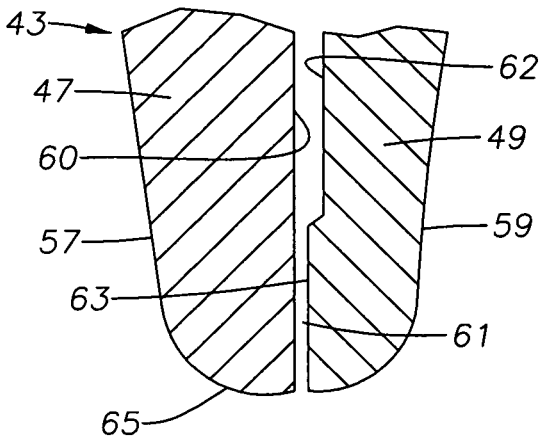
FIG. 3 is an enlarged sectional view of the nose of one of the energizing rings of the seal assembly of FIG. 1, shown prior to installation.

Referring to FIG. 3, a cylindrical surface 60 is formed on the lower outward-facing portion of inner annular member 47. A cylindrical surface 62 is formed on the lower inward-facing portion of outer annular member 49. Cylindrical surfaces 60, 62 are radially spaced apart from each other, defining a clearance or annular cavity 61 between them. Cavity 61 is located substantially equidistant between conical surfaces 57, 59.

At least one of the surfaces 60, 62, which is shown by example to be surface 62, may have a cylindrical band 63 formed on the lower end at nose 65 of upper energizing ring 43. Band 63 protrudes inward from cylindrical surface 62. Although not essential, prior to setting seal ring 31 (FIG. 1), preferably band 63 does not touch cylindrical surface 60, providing a slight gap at nose 65. During setting, band 63 will contact outward-facing cylindrical surface 60, closing the nose end of cavity 61. The axial length of inward-facing cylindrical surface 62 is preferably much greater than the axial length of band 63. Cavity 61 preferably extends for an axial distance that is at least equal to the axial length of inner and outer conical surfaces 57, 59. In this embodiment, cavity 61 extends from nose 65 to threads 51. A substantially similar cavity 61 is formed in lower energizing ring 45 in the same manner.

Figure 5:
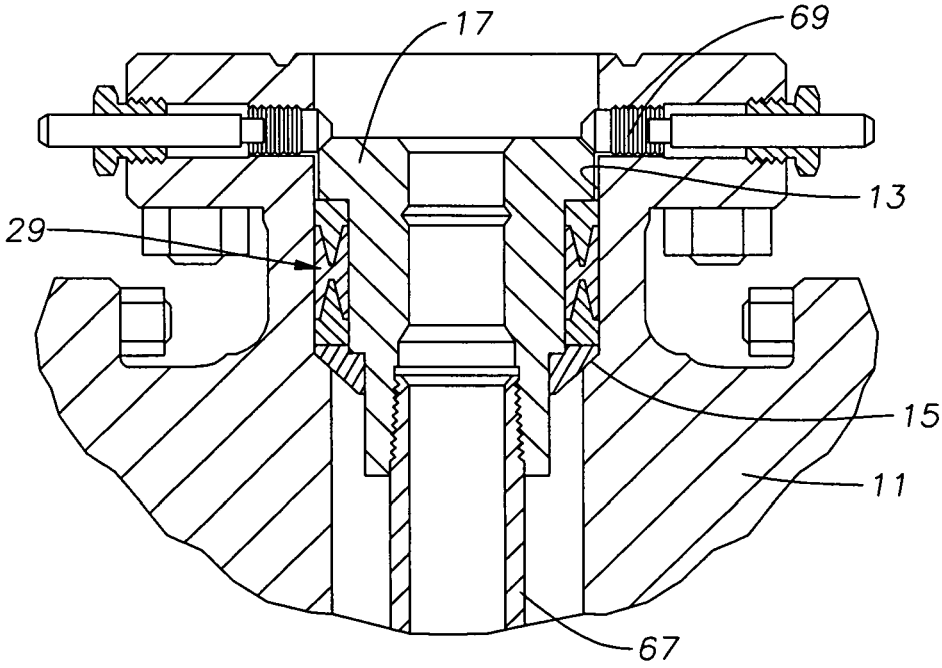
FIG. 5 is a sectional view illustrating the seal assembly of FIGS. 1-4 installed within a wellhead member.

Referring to FIG. 5, tubing hanger 17 is secured to a string of tubing 67 that extends into the well. Tubing hanger 17 is secured within tubing spool 11 by lockdown screws 69 or some other conventional device.

Figure 2:
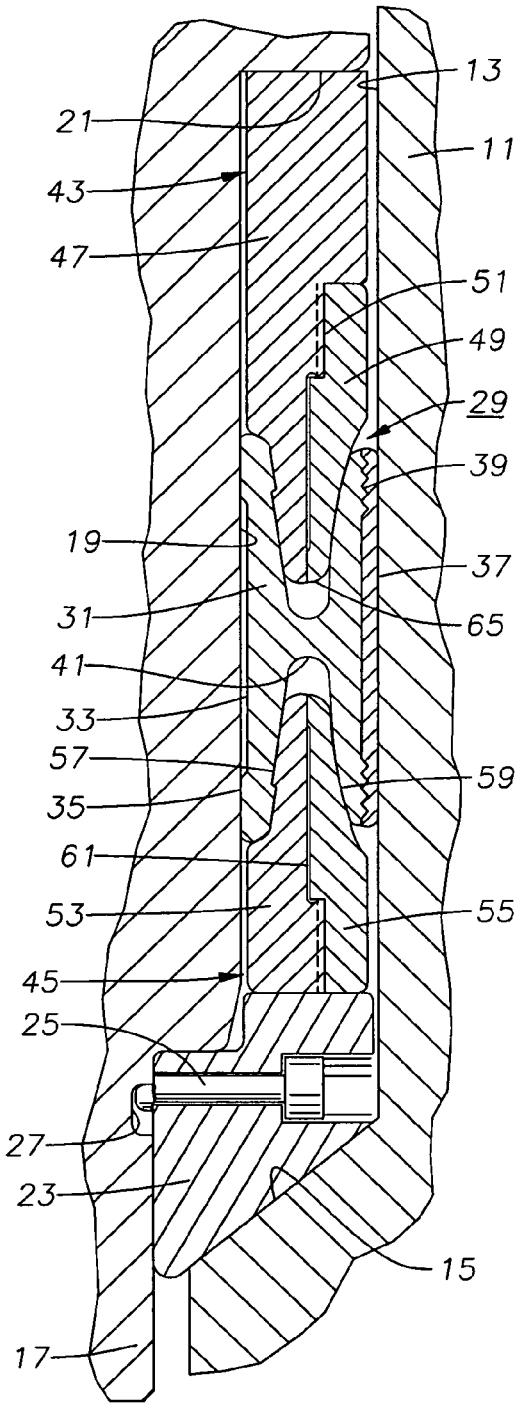
FIG. 2 is a sectional view of the seal assembly of FIG. 1 and shown in the set position after installation.

In operation, tubing 67 (FIG. 5) is made up, lowered into the well and secured to tubing hanger 17, which is carrying seal assembly 29 as shown in FIG. 1. A gap will initially exists between cylindrical band 63 and cylindrical surface 60, as shown in FIG. 3. As tubing hanger 17 is lowered into tubing spool bore 13, shoulder ring 23 will land on bore shoulder 15. The weight of tubing 67 (FIG. 5) causes shear pin 25 to shear, resulting in tubing hanger 17 moving downward relative to shoulder ring 23 to the set position shown in FIG. 2. The downward movement of tubing hanger 17 relative to shoulder ring 23 reduces the axial distance between shoulder ring 23 and downward facing shoulder 21. The reduction causes energizing rings 43, 45 to advance further into slots 41. This axial movement of energizing rings 43, 45 forces seal bands 35 radially inward into sealing engagement with the cylindrical wall of seal pocket 19. This axial movement also forces outer wall 37 of seal ring 31 outward into sealing engagement with the wall of bore 13, as shown in FIG. 2. Vent passages or penetration holes may be incorporated across band 63 and through upper and lower energizer rings 43, 45 so that a hydraulic lock condition does not prevent axial make-up of the energizer and seal system. For test and monitoring purposes, a radial cross hole may be added across seal body 31.

Figure 4:
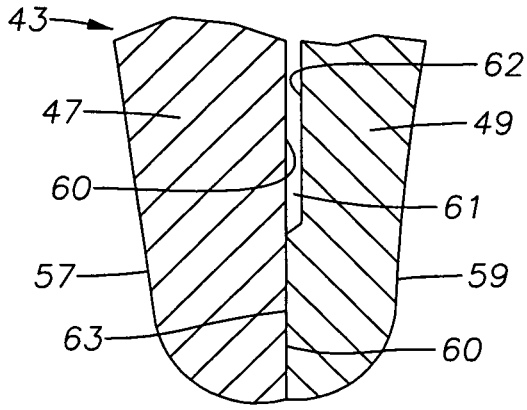
FIG. 4 is a view similar to FIG. 3, but showing the nose after installation.

Referring to FIG. 3, as inner and outer annular members 47, 49 move axially relative to seal ring 31, the radial width of cavity 61 decreases. Cavity 61 similarly decreases in width in lower energizing ring 45. Eventually band 63 contacts surface 60 as shown in FIG. 4, closing cavity 61 at nose 65, and serving as a stop member. The downward force due to the weight of tubing string 67 (FIG. 5) continues to deflect inner and outer members 47, 49 toward each other, continuing to reduce the width of cavity 61 after band 63 has contacted surface 60. At the fully set position (FIGS. 2 and 4), cavity 61 will be reduced in width over its initial position, but some clearance remains between cylindrical surfaces 60 and 62.

The deflection of inner and outer members 47, 49 toward each other preferably does not exceed the yield strength of the metal of which they are formed. Being within the elastic range, members 47, 49 continue to exert radial inward and outward forces on seal ring inner and outer walls 33, 37 after setting. This radial preload force is not dependent on weight continuing to be applied to energizing rings 43, 45 from the string of tubing 67 (FIG. 5). Because of the friction of the locking taper between energizing rings 43, 45 and the walls of slots 41, an increase in axial length of seal pocket 19 due to thermal growth will not cause energizing rings 43, 45 to back out of slots 41. The deflection of the upper and lower inner and outer walls 33, 37 of seal ring 31 is beyond the elastic limit or yield strength of the metal of seal ring 31, thus is permanent.

The invention has significant advantages. The internal cavity stores energy to maintain the metal-to-metal sealing engagement. If thermal growth later causes the tubing hanger to move axially relative to the tubing head, the downward force due to the weight of the string may be reduced or even eliminated. However, the sealing engagement is maintained because of the radial preloaded bias created by the internal cavity within each energizing ring. Additionally, radial movement due to thermal transients is accommodated without loss of the seal energy force. This flexing energizer system, in contrast to solid energizer rings of prior inventions, provides stored energy by which seal integrity is maintained. While the invention has been shown in only one of its forms, it should be apparent to those skilled in the art that it is not so limited but is susceptible to various changes without the scope. For example, in some instances, the shoulder ring could be removed, with the lower energizing ring landing directly on a shoulder in the bore of the tubing head. The seal could be configured for withstanding pressure in only a single direction, if desired, having only a single energizing ring. Each energizing ring could be formed of a single member, with the cavity formed by machining. The seal assembly could also be employed between a casing hanger and a wellhead housing.

The invention claimed is:

1. A wellhead seal assembly for sealing between inner and outer wellhead members, comprising:

a metal seal ring having inner and outer walls separated by a generally conical slot;

a metal, energizing ring having inner and outer generally conical surfaces that slidingly engage the inner and outer walls in the slot of the seal ring during installation to push the inner and outer walls into sealing engagement with the inner and outer wellhead members; and wherein the energizing ring has an internal cavity located between the inner and outer generally conical surfaces to allow the inner and outer generally conical surfaces to deflect toward each other during installation.

2. The seal assembly according to claim 1, wherein the deflection of the inner and outer conical surfaces is elastic.

3. The seal assembly according to claim 1, further comprising:

a stop member that limits the deflection of at least part of the inner and outer conical surfaces toward each other.

4. The seal assembly according to claim 1, wherein the energizing ring has a nose at an end of the inner and outer conical surfaces, and the cavity has a portion that extends through the nose.

5. The seal assembly according to claim 1, wherein the energizing ring comprises:

an inner annular member and an outer annular member secured together, the inner and outer annular members having outward-facing and inward-facing cavity walls, respectively, that define the cavity.

6. The seal assembly according to claim 5, wherein one of the annular members has a protruding band formed at an end of its cavity wall for contacting the cavity wall of the other annular member.

7. The seal assembly according to claim 1, wherein the energizing ring has a supporting portion with inner and outer cylindrical walls that join the inner and outer conical surfaces, the supporting portion having a radial thickness substantially the same as a radial thickness of the seal ring.

8. The seal assembly according to claim 1, wherein:

the internal cavity has cavity walls are radially spaced apart from each other prior to the installation; and after the installation, the cavity walls are still spaced apart from each other but by a lesser amount.

9. A wellhead seal assembly for sealing between inner and outer wellhead members, comprising:

a metal seal ring having an inner and outer walls separated by a slot that reduces in width;

a metal inner annular member having an outward-facing cavity surface and a conical inner surface;

a metal outer annular member having an inward-facing cavity surface and a conical outer surface, the inner and outer annular members having supporting portions fastened to each other, defining an energizing ring, at least portions of the cavity surfaces being separated from each other; wherein during installation of the seal, the energizing ring moves farther in the slot, with the inner surface of the inner annular member slidingly engaging the inner wall of the seal and the outer surface of the outer annular member slidingly engaging the outer wall of the seal to wedge the inner and outer walls into sealing engagement with the inner and outer wellhead members;

portions of the inner and outer annular members deflect radially toward each other during the installation, causing at least portions of the cavity surfaces to move toward but not touch each other; and the deflection of portions of the inner and outer annular members being within an elastic range of the metal of the annular members so as to provide a radial preload force of the inner and outer walls against the inner and outer wellhead members.

10. The seal assembly according to claim 9, further comprising:

an annular band located on and protruding from an end of one of the cavity surfaces, the annular band contacting the cavity surface of the other of the annular members during the installation.

11. The seal assembly according to claim 9, wherein the inner and outer annular members of the energizing ring are secured to each other by threads.

12. The seal assembly according to claim 9, wherein the cavity surfaces have axial lengths at least equal to the axial lengths of the conical inner and outer surfaces.

13. The seal assembly according to claim 9, wherein the energizing ring has a supporting portion with a radial thickness substantially the same as a radial thickness of the seal ring.

14. The seal assembly according to claim 9, wherein the cavity surfaces are cylindrical.

15. A wellhead assembly, comprising:

an outer wellhead member;

an inner wellhead member for securing to a string of conduit and landing within the outer wellhead member;

a metal seal ring carried by the inner wellhead member and having an upper section and a lower section, each of the sections having inner and outer walls separated by a conical slot;

upper and lower energizing rings carried by the inner wellhead member in engagement with the slots in the upper and lower sections, respectively;

upper and lower shoulders on the inner wellhead member that are configured to move toward each other in response to weight of the string of conduit when the inner wellhead member lands in the outer wellhead member, causing the upper and lower energizing rings to move toward each other;

an engaging portion of each of the energizing rings having conical inner and outer surfaces that wedge the inner and outer walls of one of the sections of the seal ring apart into sealing engagement with the inner and outer wellhead members when the engaging portions are advanced into the slots;

an internal annular cavity extending within the engaging portion of each of the energizing rings for an axial length that is at least equal to an axial length of the engaging portion of each of the energizing rings; and wherein during installation of the seal, the annular cavity reduces in radial width and the conical portions of each of the energizing rings elastically deflect toward each other.

16. The wellhead assembly according to claim 15, wherein:

each of the engaging portions has a nose;

each of the cavities has an nose portion at the nose that prior to installation has a lesser width than the remaining portion of each of the cavities; and during installation, the nose portions of the cavities close up.

17. The wellhead assembly according to claim 15, wherein each of the energizing rings comprises:

an inner annular member and an outer annular member secured to each other; and the inner annular member having an outward-facing cavity surface radially spaced from an inward-facing cavity surface of the outer annular member to define the cavity.

18. The wellhead assembly according to claim 17, wherein one of the cavity surfaces has an end portion containing a protruding band, the band spaced from the other of the cavity surfaces prior to the installation and contacting the other of the cavity surfaces after the installation.

19. The wellhead assembly according to claim 15, wherein the cavity has a cylindrical configuration.

* * * * *